US011819143B2

(12) United States Patent
Kubiak

(10) Patent No.: US 11,819,143 B2
(45) Date of Patent: Nov. 21, 2023

(54) CHANGING TABLE

(71) Applicant: Joseph Kubiak, Oberlin, OH (US)

(72) Inventor: Joseph Kubiak, Oberlin, OH (US)

( * ) Notice: Subject to any disclaimer, the term of this patent is extended or adjusted under 35 U.S.C. 154(b) by 0 days.

(21) Appl. No.: 17/720,762

(22) Filed: Apr. 14, 2022

(65) Prior Publication Data

US 2023/0329448 A1 Oct. 19, 2023

(51) Int. Cl.
*A47D 5/00* (2006.01)

(52) U.S. Cl.
CPC ..... *A47D 5/00* (2013.01)

(58) Field of Classification Search
USPC ..... 5/655
See application file for complete search history.

(56) References Cited

U.S. PATENT DOCUMENTS 11,278,128 B1 * 3/2022 Flannery ..... A47D 5/00
2004/0187212 A1 * 9/2004 Pacella ..... A47D 13/06 5/503.1
2007/0265144 A1 * 11/2007 Jackson ..... A47B 83/02 297/137
2007/0266498 A1 * 11/2007 Lord ..... A47D 5/00 5/655
2018/0080810 A1 * 3/2018 Weiss ..... G01G 19/52

* cited by examiner

*Primary Examiner* — Justin C Mikowski
*Assistant Examiner* — Adam C Ortiz
(74) *Attorney, Agent, or Firm* — Daniel M. Cohn; Howard M. Cohn

(57) ABSTRACT

An improved changing table including a changing basket comprising an outer facing enclosure and an inner facing enclosure. The outer facing enclosure is formed of an outer facing side of a support surface enclosed by first and second end walls and first and second side walls extending about the outer facing side of the support surface. The inner facing enclosure is formed of an inner facing side of the support surface enclosed by the first and second end walls and the first and second side walls extending about the inner facing side of the support surface. A mounting board is adapted to be secured within the inner facing enclosure on the inner facing side of the support surface.

15 Claims, 5 Drawing Sheets

CHANGING TABLE

TECHNICAL FIELD OF THE INVENTION

The present invention relates to an improved changing table for changing a baby's diaper. More specifically, the invention is directed to a changing basket comprising an outer facing enclosure and an inner facing enclosure, mounted to a mounting board.

BACKGROUND OF THE INVENTION

Currently, diapers or other absorbent articles find widespread use in infant care and have generally replaced reusable, or washable, cloth absorbent articles. A typical disposable diaper or other absorbent article is a three-layered composite structure comprising a liquid-permeable topsheet, a liquid-impermeable backsheet, an absorbent assembly between the topsheet and backsheet, and a means for fastening the diaper or article to the wearer. A routine which is repetitively familiar to parents of infants everywhere, involves the handling of soiled diapers, and the infant cleanup which follows.

Infant diaper changing practices and structures have progressed from the use of a bed to changing tables of the kind contrived by mounting a soft pad over a dresser or other stationary furniture for use at various locations. There are many situations where either there are not enough rooms to set up a separate baby nursery or limited space to set up a separate changing station such as the use of a dresser or other furniture to change the infant's diapers. In those circumstances, it is common practice to use a bed, the floor, carpet, or even the dinner table to change the infant's soiled diapers, compromising hygiene. Thus, there is a need in the art for a hygienic and space saving structure specifically dedicated to the infant's diaper changing needs in locations with limited space.

SUMMARY OF THE INVENTION

According to an embodiment of the present invention, there is disclosed an improved changing table, for changing a baby's diaper. The improved changing table includes a changing basket comprising an outer facing enclosure and an inner facing enclosure. The outer facing enclosure is formed of an outer facing side of a support surface enclosed by first and second end walls and first and second side walls extending about the outer facing side of the support surface. The inner facing enclosure is formed of an inner facing side of the support surface enclosed by the first and second end walls and the first and second side walls extending about the inner facing side of the support surface. The inner facing side of the support surface is spaced from the first and second end walls and the first and second side walls wherein the width of the inner facing side of the support surface is less than the distance between the first and second side walls and the length of the inner facing side of the support surface is less than the distance between the first and second end walls. A mounting board is adapted to be secured within the inner facing enclosure on the inner facing side of the support surface.

According to another embodiment of the present invention, there is disclosed an improved changing table, for changing a baby's diaper. The improved changing table includes a changing basket comprising an outer facing enclosure and an inner facing enclosure. The outer facing enclosure is formed of an outer facing side of a support surface enclosed by first and second end walls and first and second side walls extending about the outer facing side of the support surface. The inner facing enclosure is formed of an inner facing side of the support surface enclosed by the first and second end walls and the first and second side walls extending about the inner facing side of the support surface. The inner facing side of the support surface is spaced from the first and second end walls and the first and second side walls wherein the width of the inner facing side of the support surface is less than the distance between the first and second side walls and the length of the inner facing side of the support surface is less than the distance between the first and second end walls. A channel is formed about a periphery of the inner facing side of the support surface. A mounting board is disposed on a flat surface of a table adapted to be secured within the inner facing enclosure on the inner facing side of the support surface.

BRIEF DESCRIPTION OF THE DRAWINGS

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

Figure 1:
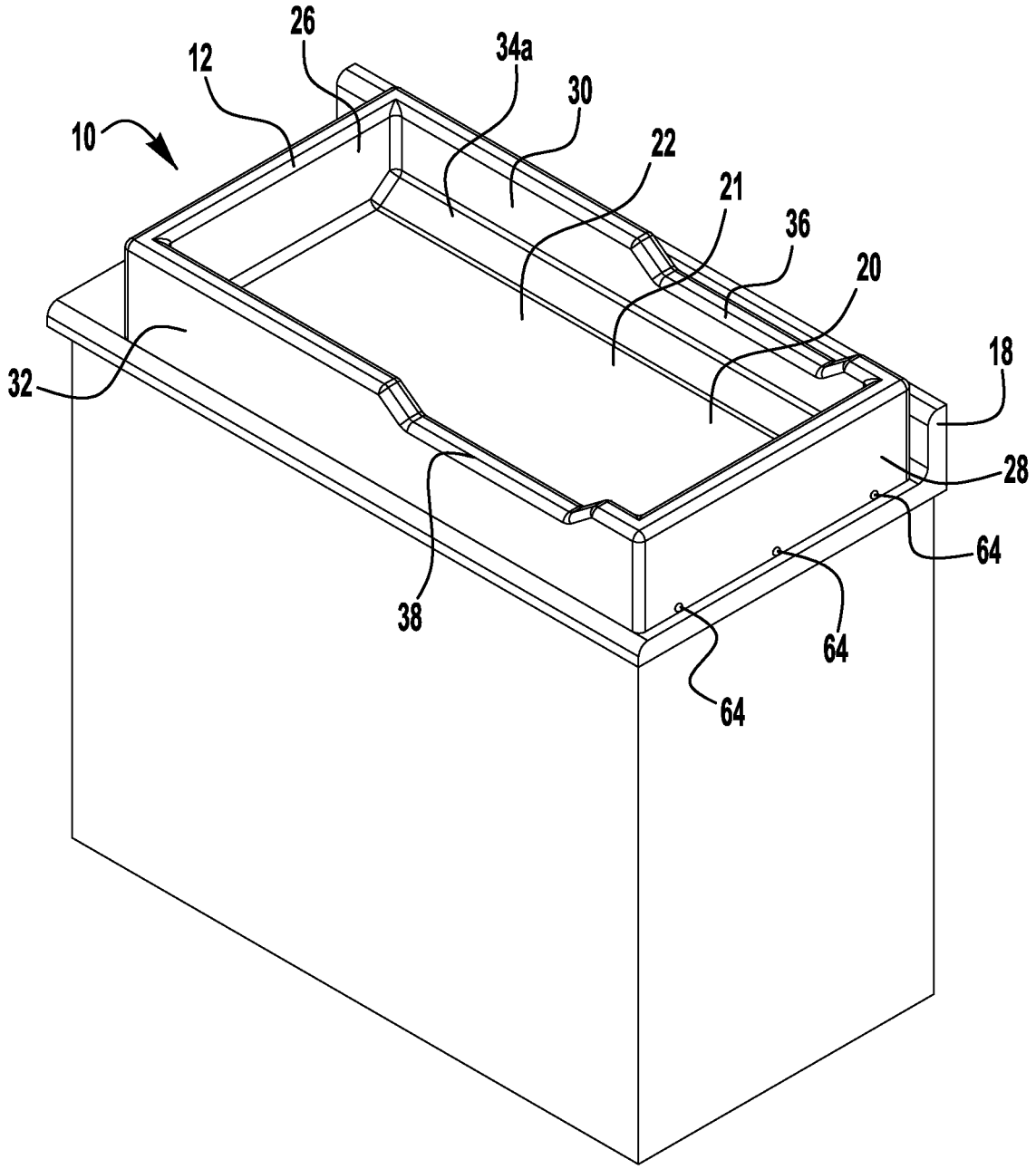

In the drawings accompanying the description that follows, often both reference numerals and legends (labels, text descriptions) will be used to identify elements. If legends are provided, they are intended merely as an aid to the reader, and should not in any way be interpreted as limiting.

FIG. 1 is a front, three-dimensional view of the improved changing table resting on a counter, in accordance with the present invention.

Figure 2:
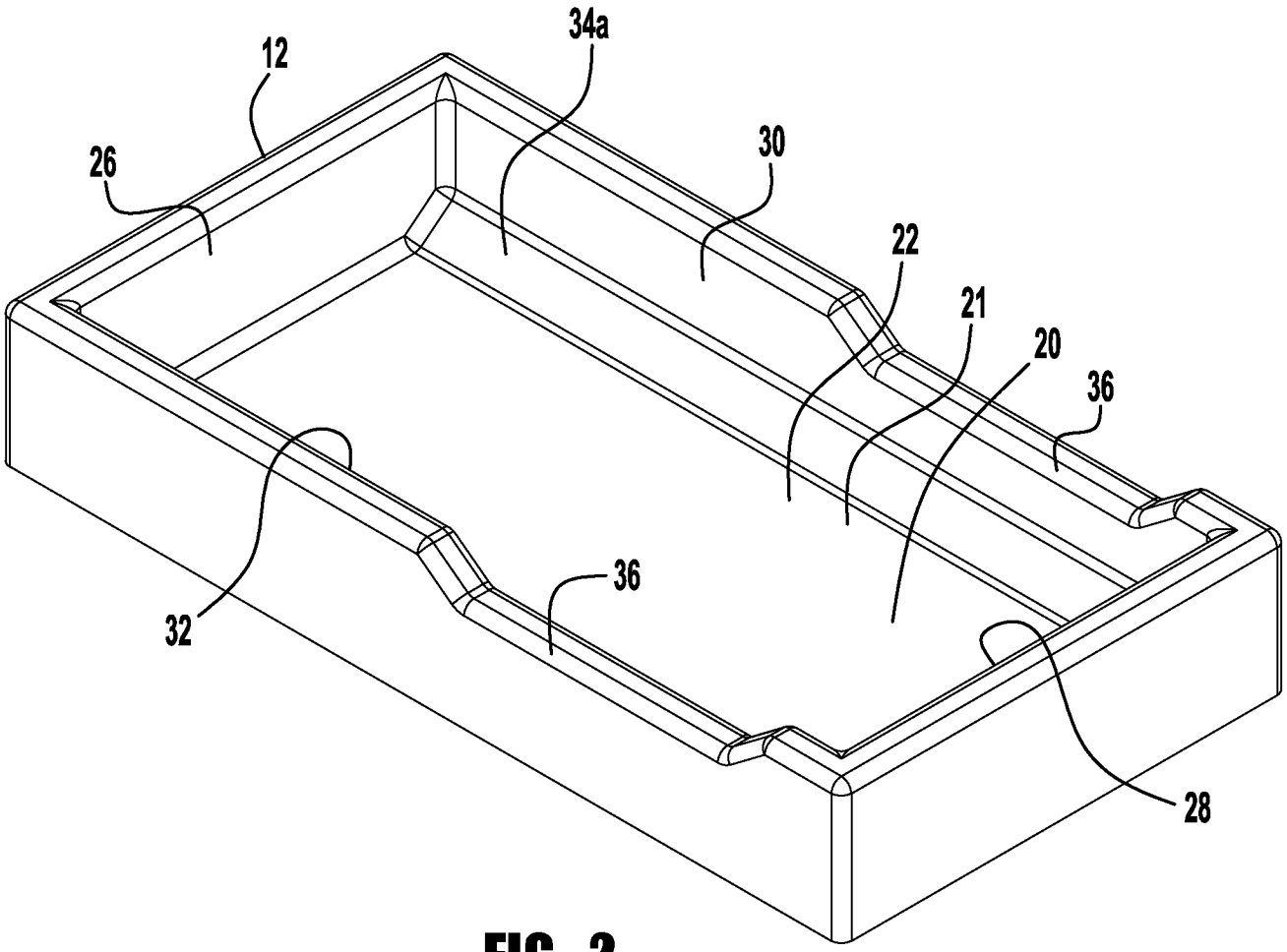

FIG. 2 is a side, three-dimensional view of the changing basket of the improved changing table, in accordance with the present invention.

Figure 3:
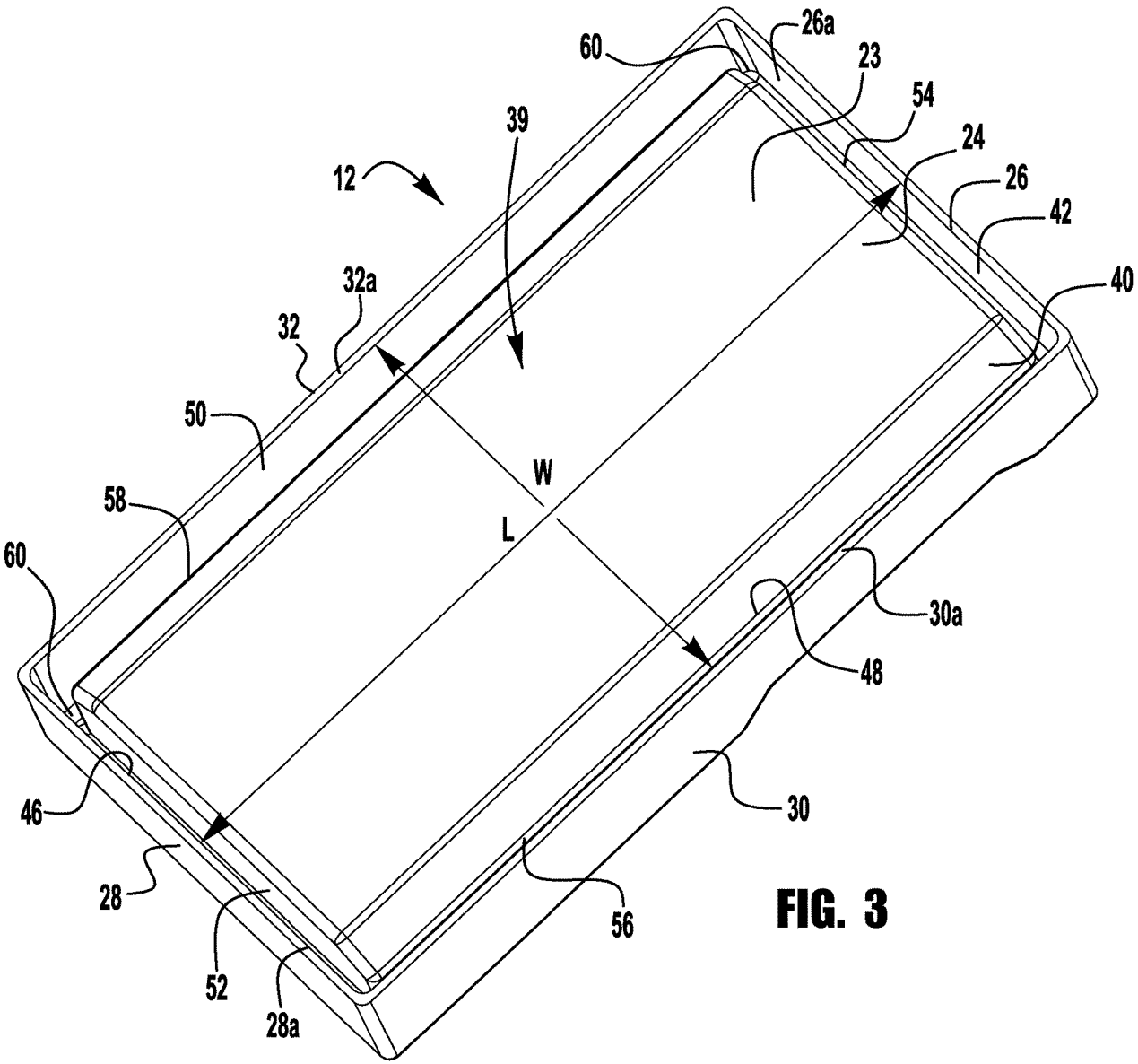

FIG. 3 is a bottom three dimensional view of the changing basket of the improved changing table, in accordance with the present invention.

Figure 4:
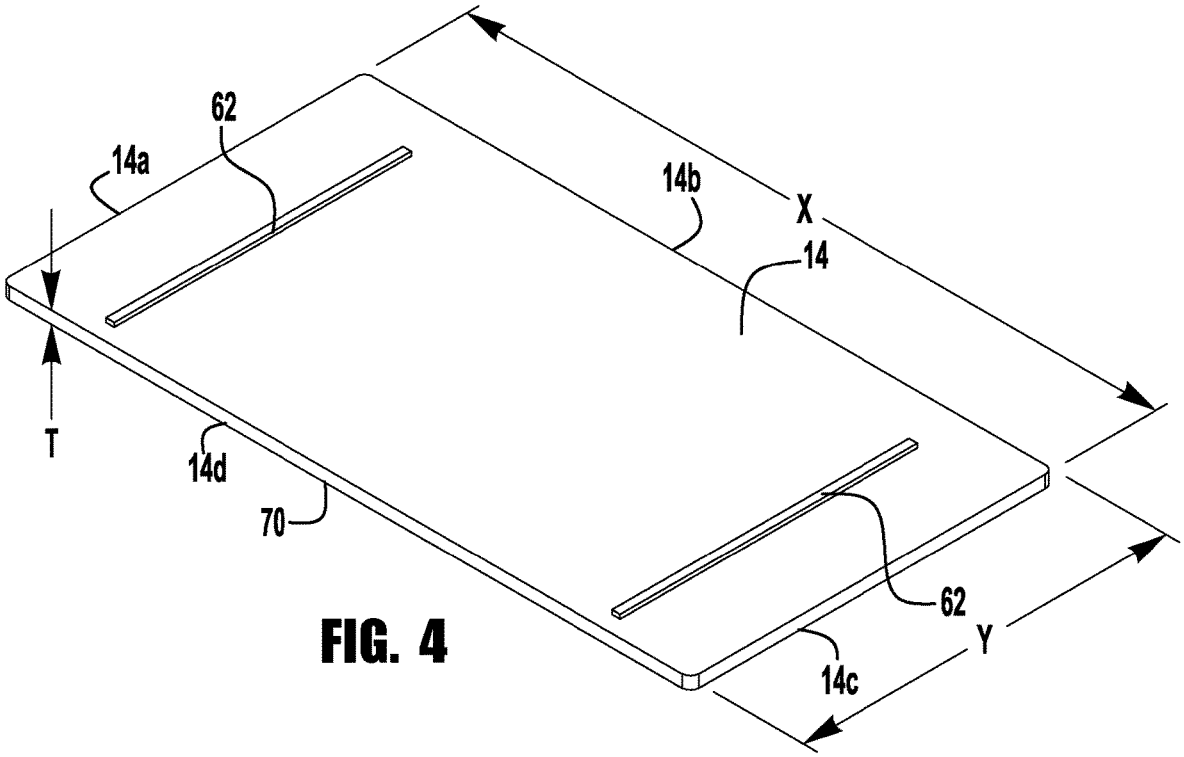

FIG. 4 is a front three-dimensional view of the mounting board of the improved changing table, in accordance with the present invention.

FIG. **4*a*** is a front three-dimensional view of the mounting board of the improved changing table disposed upon a counter, in accordance with the present invention.

Figure 5:
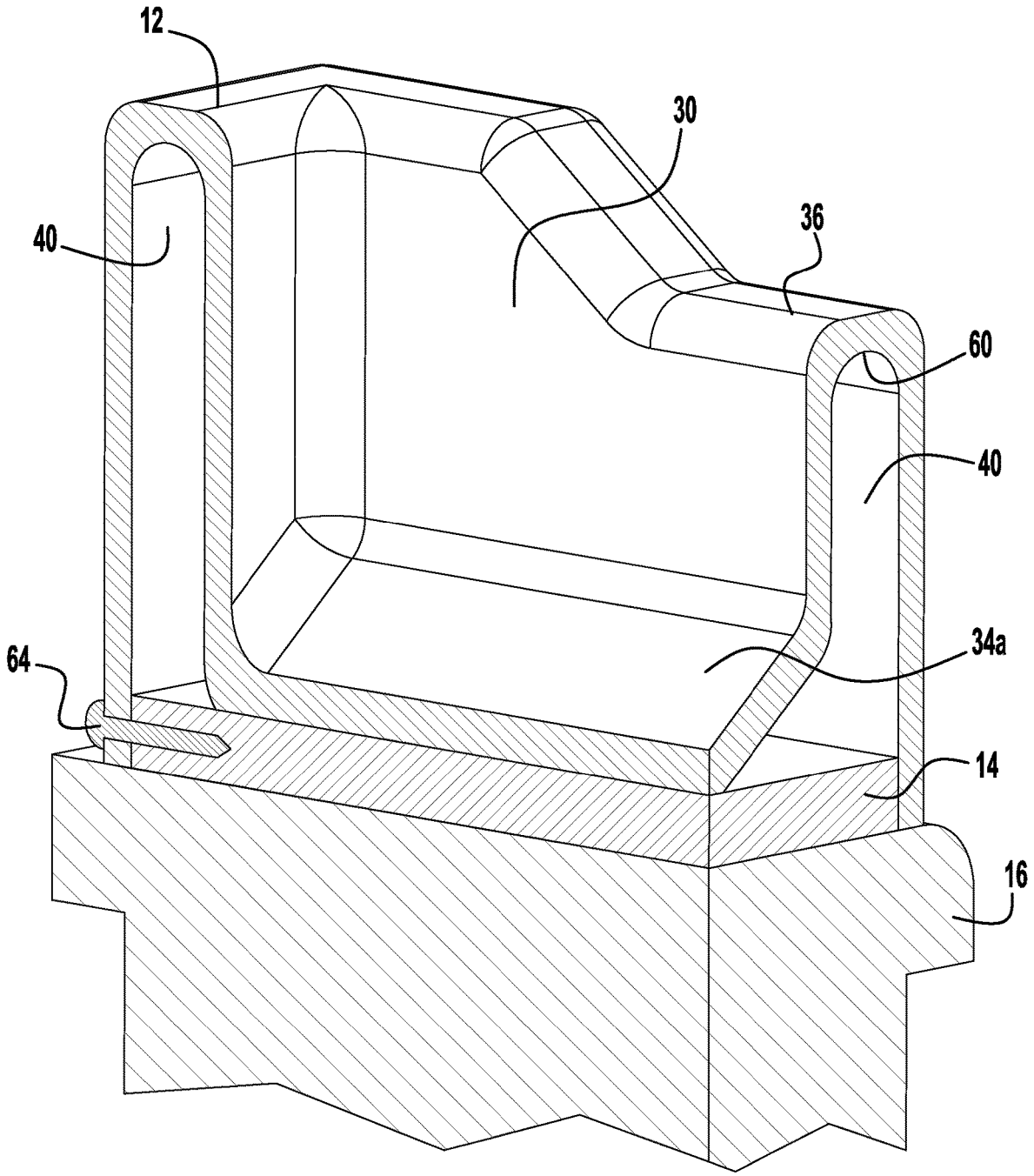

FIG. 5 is a cross-sectional view of a corner of the improved changing table resting on a counter, in accordance with the present invention.

DETAILED DESCRIPTION OF THE PREFERRED EMBODIMENTS

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Since the advent of diapers, individuals charged with the care of infants and toddlers have been searching for the most convenient and safe method of changing them. Indeed, furniture designers have even adapted furniture specifically for this purpose, Such furniture, often referred to as baby changing tables, are typically dresser-like structures that have a work surface positioned at a height particularly suitable for placement of the baby in a comfortable position for the caregiver while changing a soiled diaper. They are particularly useful because they provide a centrally located and accessible storage area for items necessary to assist with the changing, such as spare diapers, wipes, and creams, FIG. 1 illustrates a front view of the improved changing table 10. The changing table 10 includes a changing basket 12, which is securedly mounted to a generally rectangular shaped mounting board 14, as seen in FIG. 4. The changing table 10 is disposed atop any flat surface, preferably a counter 16 upon which the mounting board is firmly secured. As illustrated, the counter 16 includes a lip 18 which may abut against a wall. Typically, the counter will be of a sufficient height to allow an infant caretaker to comfortably access the changing table 10 to properly change the infant's diaper.

It is within the scope of the embodiment that there be various configurable and removable dispenser and storage tubs or compartments formed into the counter 16 for a variety of purposes. For example, there may be a dispenser mounted in or on counter 16 designed to accept sanitary wipes. The dispenser can include a snap closure lid that has a slot for the dispensation of wipes, tissues or other dispensable items. In one embodiment, the dispensing tub includes a cap with a lanyard attachment point to secure the dispensing tub cap to the tub cover. The snap closure lid provides a secure compartment in which to store associated items such as lotions, gels, pacifiers, toys and/or additional diapers.

FIG. 2 illustrates a side three-dimensional view of the changing basket 12. The changing basket 12 is designed to hold the baby while being changed. In the depicted embodiment, the changing basket 12 is a one piece, formed body which is generally shaped in a rectangular fashion as shown. In one embodiment, changing basket 12 is manufactured by a plastic mold injection process which produces a stationary housing that is nonporous, rigid or semi-rigid as preferred by the user. A plastic "skin" is created on the surface of the changing basket 12 during the manufacturing process of the changing basket to resist absorption and staining and which is easily cleaned and sanitized after use. Such material may be easily manufactured with a wide degree of color, texture, shapes and designs integrated therewith. The changing basket 12 may have any desired dimensions. For example, the changing basket may have a length within a range of between inches and inches, a width within a range of between inches and inches and a height within a range of between inches and inches.

In alternative embodiments, changing basket 12 may be constructed from various plastics, polyurethane resins, foams, metal, metal alloys, wood or other suitable materials as known in the art. The changing basket 12 may also include antimicrobial additives in the polyurethane resin to resist and deter microbial growth and odor. In other contemplated embodiments, changing basket 12 may consist of two or more members comprising components of the changing basket, and an optional headrest (not shown). The changing basket 12 is contoured in shape to provide a secure and easily sanitized surface on which to lay and secure the infant or child being changed.

The changing basket 12 generally includes a support surface 22 enclosed by interior facing sides of first and second end walls 26 and 28, and first and second side walls 30 and 32. The interior facing sides of the first and second end walls 26 and 28 and the first and second side walls 30 and 32 project outwardly from the outer facing side 21 of the support surface 22 to form an outer facing enclosure 20. The opposite ends of each end wall 26 and 28 of the outer facing enclosure 20 abut opposite ends of first side wall 30, and opposite ends of the second side wall 32. Thus, the outer facing enclosure 20, formed by the outer facing sides of the first and second end walls 26 and 28 and the first and second side walls 30 and 32 and the support surface 22, is contiguous so that any fluids or liquids are contained within the enclosure 20 and can be easily cleaned.

The support surface 22 is oriented generally horizontally and is configured for supporting a child, such as an infant or a toddler, above a floor to facilitate a diaper change. Preferably, the outer facing enclosure 20 and the support surface 22 provide a soft and secure area for the child while the child's diaper is being changed. It is within the terms of the embodiment that there be a belt or other retention device be looped over the child's torso to further releasably secure or restrict the child from gross movement during the changing process.

There are elongated triangular inserts 34*a* and 34*b* (not seen), having opposite ends abutting the inner facing surfaces of the first and second end walls 26 and 28, respectively. The elongated triangular inserts 34*a* and 34*b* provide an angled intersection to provide comfort to the baby when in the changing basket 12, as compared to the intersection of the support surface 22 and the inner facing sides of side walls 28 and 32 which are at approximately a 90 degree angle to each other. Further, the elongated triangular inserts 34*a* and 34*b* provide for easier clean up of the outer facing enclosure 20.

The first and second side walls 30 and 32 each contain cutout sections 36 and 38, respectively, stepped down from the outer edges of the first and second side walls to provide an access opening for reaching within the outer facing enclosure 20 to change, move, or remove the baby held therein.

Referring to FIG. 3, there is illustrated a bottom view of the changing basket 12, illustrating an inner facing enclosure 39 adapted to receive the generally rectangular shaped mounting board 14, as shown in FIG. 5. The inner facing enclosure 39 includes the inner facing side 23 of the support surface 22 and the inside facing surfaces 42 and 46 of the first and second end walls 26 and 28 and the inside facing surfaces 48 and 50 of the first and second side walls 30 and 32, respectively. The length L between the inside facing surfaces 42 and 46 and the width W between the inside facing side 23 of the inner facing enclosure 39 is slightly less than the length X and the width Y of the generally rectangular shaped mounting board 14, as shown in FIG. 5. Moreover, the inside facing side 23 of the inner facing enclosure 39 is spaced below the bottom edges 26*a*, 28*a*, 30*a* and 32*a* of the first and second end walls 26 and 28, and the first and second side walls 30 and 32, respectively, a distance that is substantially the same or slightly greater than the thickness T of the mounting board 14, as shown in FIG. 4.

Inside facing surfaces 48 and 50 of the first and second side walls 30 and 32 and inside facing surfaces 42 and 46 of the first and second end walls 26 and 28, generally form the outer periphery of the inner facing enclosure 39. Referring to FIG. 3, the height of the first and second end walls 26 and 28, and the first and second side walls 30 and 32 is greater than the height of the first and second outer facing end walls 52 and 54 and the first and second outer facing side walls 56 and 58 abutting an inner facing side 23 of the support surface 22. This is so that the inner facing side 23 of the support surface 22 is below the bottom edges of the first and second end walls 26 and 28, and the first and second side walls 30 and 32, a distance that is substantially the same as the thickness T of the mounting board 14. In this way, the inner facing side 23 of the support surface 22, is adapted to rest on the mounting board 14, so that the changing basket 12 can be firmly secured on the counter 16.

There is a channel 40 that is formed about the periphery of the inner facing side 23 of the support surface 22 and the inside facing surfaces 42, 46, 48, and 50 of the first and second end walls 26 and 28, and first and second side walls 30 and 32, respectively.

The channel 40 extends between the inside facing surfaces 42, 46, 48, and 50 of the first and second end walls 26 and 28, respectively, and the first and second side walls 30 and 32 and the first and second end walls 52 and 54 and the first and second side walls 56 and 58 abutting an inner facing side 23 of the support surface 22. The channel 40 has a generally U-shaped bottom surface 60 that intersects the inside facing surfaces 42, 46, 48, and 50 of the first and second end walls 26 and 28, and the first and second side walls 30 and 32. The generally U-shaped bottom surface 60 also that intersects the first and second end walls 52 and 54 and the first and second side walls 56 and 58 abutting the inner facing side 23 of the support surface 22.

Referring to FIG. 5, the height of the first and second end walls 26 and 28, and first and second side walls 30 and 32 is greater than the height of the first and second end walls 52 and 54 and first and second side walls 56 and 58 of the support side 23. This is so that the inner facing side 23 of the support surface 22 is below the bottom edges of the first and second end walls 26 and 28, and the first and second side walls 30 and 32, a distance that is substantially the same as the thickness T of the mounting board 14. In this way, the inner facing side 23 of the support surface 22, is adapted to rest on the mounting board 14, so that the changing basket 12 can be firmly secured on the counter 16.

The length and or width of the mounting board 14 can be slightly less than the space between the inside facing surfaces 42, 46, 48, and 50 of the first and second end walls 26 and 28, respectively, and the first and second side walls 30 and 32, respectively, so that the changing basket 12 can be secured to the mounting board 14.

Figure 4A:
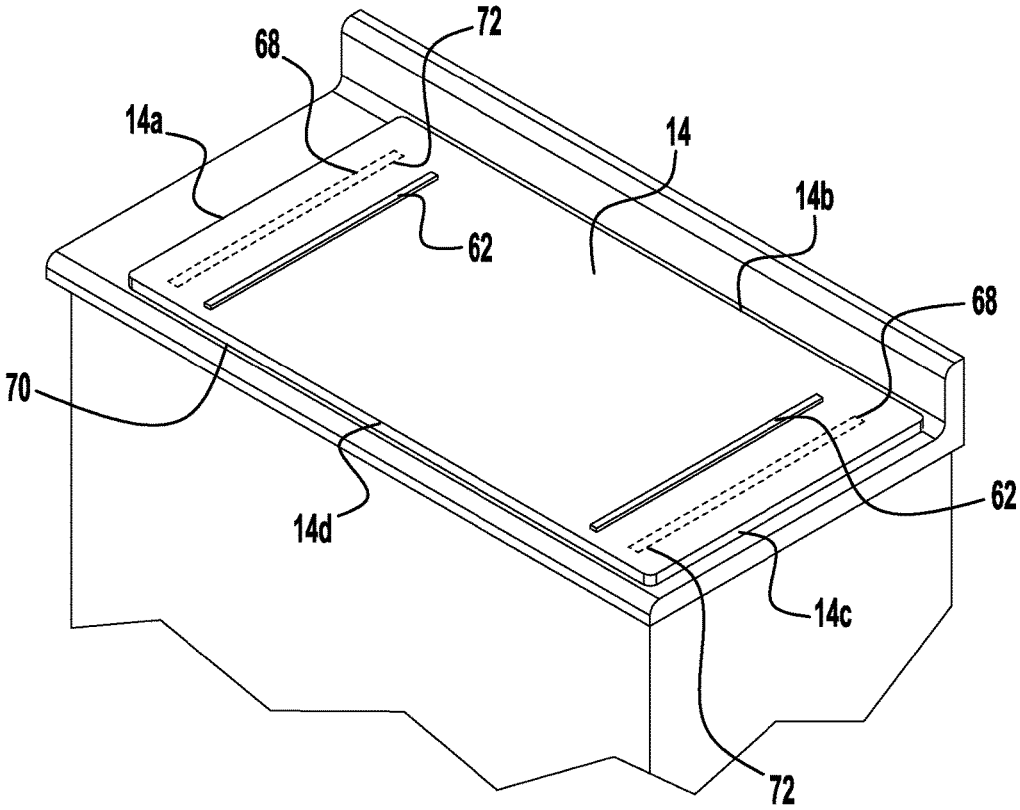

As seen in FIG. 4*a*, the mounting board 14 is secured to the counter 16 in any desired fashion, such as with adhesive, nails, screws, etc. Preferably, one or more velcro strips 68 is disposed on the underside 70 of the mounting board 14. The velcro strip 68 corresponds to one or more velcro strips 72, disposed on the counter 16. Thus, the mounting board 14 may be easily transferred from one location to another, by providing mounting means such as one or more velcro strips 72 on the surface to which the mounting board 14 is to be attached. The changing basket 12 is secured to the mounting board 14, as shown in FIG. 5, and secured both with adhesive strips 62, as well as screws 64 that extend through the first and second end walls 26 and 28, and first and second side walls 30 and 32 and into outer edges 14, 14*b*, 14*c*, and 14*d* of the mounting board 14.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An improved changing table, for changing a baby's diaper, comprising;

a changing basket comprising an outer facing enclosure and an inner facing enclosure; the outer facing enclosure formed of an outer facing side of a support surface enclosed by first and second end walls and first and second side walls extending about the outer facing side of the support surface;

the inner facing enclosure formed of an inner facing side of the support surface enclosed by the first and second end walls and the first and second side walls extending about the inner facing side of the support surface;

the inner facing side of the support surface spaced from the first and second end walls and the first and second side walls wherein a width of the inner facing side of the support surface is less than a distance between the first and second side walls and a length of the inner facing side of the support surface is less than the distance between the first and second end walls; and a mounting board adapted to be secured within the inner facing enclosure on the inner facing side of the support surface; and, wherein the changing basket is secured to the mounting board with screws that extend through the first and second end walls, and first and second side walls and into outer edges of the mounting board.

2. The improved changing table of claim 1, wherein the inner facing side of the support surface is adapted to rest on the mounting board.

3. The improved changing table of claim 2, wherein a channel is formed about a periphery of the inner facing side of the support surface.

4. The improved changing table of claim 3, wherein the channel is formed between a inside facing surfaces of the first and second end walls, and the first and second side walls and between the first and second end walls and the first and second side walls abutting an inner facing surface of the support surface.

5. The improved changing table of claim 4, wherein the channel has a generally U-shaped bottom surface that intersects the inside facing surfaces of the first and second end walls, and the first and second side walls, and the first and second end walls and the first and second side walls abutting an inner facing surface of the support surface.

6. The improved changing table of claim 4 wherein a height of the first and second end walls and first and second side walls, is greater than the height of the first and second end walls and first and second side walls abutting the inner facing side of the support surface, such that the inner facing side of the support surface is below bottom edges of the first and second end walls, and the first and second side walls.

7. The improved changing table of claim 6, wherein the inner facing side of the support surface is below the bottom edges of the first and second end walls and the first and second side walls a distance that is substantially the same as a thickness of the mounting board to allow the inner facing side of the support surface to rest on the mounting board.

8. The improved changing table of claim 1, wherein elongated triangular inserts, have opposite ends abutting inner surfaces of the first and second end walls, respectively, for providing an angled intersection to provide comfort to the baby when in the changing basket.

9. The improved changing table of claim 8, wherein the first and second side walls each contain cutout sections, stepped down from outer edges of the first and second side walls to provide an access opening for reaching within the enclosure to change, move, or remove a baby held therein.

10. The improved changing table of claim 1, wherein one or more adhesive strips are disposed on an underside of the mounting board, correspond to one or more adhesive strips disposed on a counter.

11. The improved changing table of claim 1, wherein the changing basket is secured to the mounting board with adhesive strips.

12. The improved changing table of claim 1, wherein opposite ends of the first and second end walls of the outer facing enclosure abut opposite ends of the first and second side walls such that the enclosure is contiguous so that any liquids contained within the outer facing enclosure can be easily removed.

13. An improved changing table, for changing a baby's diaper, comprising;

a changing basket comprising an outer facing enclosure and an inner facing enclosure;

the outer facing enclosure formed of an outer facing side of a support surface enclosed by first and second end walls and first and second side walls extending about the outer facing side of the support surface;

the inner facing enclosure formed of an inner facing side of the support surface enclosed by the first and second end walls and the first and second side walls extending about the inner facing side of the support surface;

the inner facing side of the support surface spaced from the first and second end walls and the first and second side walls wherein the width of the inner facing side of the support surface is less than the distance between the first and second side walls and the length of the inner facing side of the support surface is less than the distance between the first and second end walls;

a channel formed about a periphery of the inner facing side of the support surface; and a mounting board disposed on a flat surface of a table adapted to be secured within the inner facing enclosure on the inner facing side of the support surface; and wherein the channel is formed between a inside facing surfaces of the first and second end walls, and the first and second side walls and between the first and second end walls and the first and second side walls abutting an inner facing surface of the support surface.

14. The improved changing table of claim 13, wherein the channel has a generally U-shaped bottom surface that intersects the inside facing surfaces of the first and second end walls, and the first and second side walls, and the first and second end walls and the first and second side walls abutting an inner facing surface of the support surface.

15. The improved changing table of claim 14 wherein a height of the first and second end walls and first and second side walls, is greater than the height of the first and second end walls and first and second side walls abutting the inner facing side of the support surface, such that the inner facing side of the support surface is below bottom edges of the first and second end walls, and the first and second side walls.

* * * * *